United States Patent [19]

Hunting

[11] Patent Number: 4,850,844

[45] Date of Patent: Jul. 25, 1989

[54] APPARATUS FOR MAKING TAPERED PLASTIC SHINGLES

[76] Inventor: William E. Hunting, 8167 River Front La., Fair Oaks, Calif. 95628

[21] Appl. No.: 95,753

[22] Filed: Sep. 11, 1987

[51] Int. Cl.[4] ..... B26B 27/00; B26D 1/02

[52] U.S. Cl. ..... 425/289; 425/295; 425/306; 264/158; 83/870; 83/874; 83/16; 83/171

[58] Field of Search ..... 83/870, 871, 874, 16, 83/171; 264/145, 146, 158; 425/289, 295

[56] References Cited

U.S. PATENT DOCUMENTS

| | | | |
|---|---|---|---|
| 287,699 | 10/1883 | Meeker | 264/146 |
| 1,880,872 | 10/1932 | Denton | 425/289 |
| 1,960,773 | 5/1934 | Duis | 425/142 |
| 3,212,376 | 10/1965 | Berenbak | 83/874 |
| 3,244,039 | 4/1966 | Crabb | 83/874 |
| 3,358,343 | 12/1967 | Kahili | 425/289 |
| 3,734,991 | 5/1973 | Vrijma | 264/157 |
| 3,986,416 | 10/1976 | Wade | 425/289 |
| 4,018,116 | 4/1977 | Treffner | 83/870 |
| 4,106,377 | 8/1978 | Owen | 83/874 |
| 4,215,607 | 8/1980 | Hudson | 83/16 |
| 4,221,148 | 9/1980 | Lewis | 83/874 |
| 4,536,145 | 8/1985 | Sawyer et al. | 425/289 |
| 4,574,677 | 3/1986 | Huhne | 83/870 |
| 4,608,893 | 9/1986 | Huhne | 83/870 |
| 4,672,872 | 6/1987 | Kuehnert | 83/16 |
| 4,683,791 | 8/1987 | Dermont | 83/870 |
| 4,683,792 | 8/1987 | Dermont | 83/874 |

*Primary Examiner*—Jay H. Woo
*Assistant Examiner*—Jeremiah F. Durkin, II
*Attorney, Agent, or Firm*—Phillips, Moore, Lempio & Finley

[57] ABSTRACT

An apparatus for making tapered plastic shingles including a conveyor for moving a block of plastic shingle material along a linear path and at least one heated wire extending transversely across the path to cut the block into two or more tapered shingle slabs. The shingle slabs are thereafter cut to form shingles or slotted to resemble individual shingles of desired widths. One end of the wire is adapted to be adjusted vertically to selectively vary the acute angle of the wire relative to the horizontal plane to thus vary shingle taper. A mechanism is also provided for continuously reciprocating the wire vertically to impart a textured surface to opposed, cut surfaces of the shingle slabs.

24 Claims, 3 Drawing Sheets

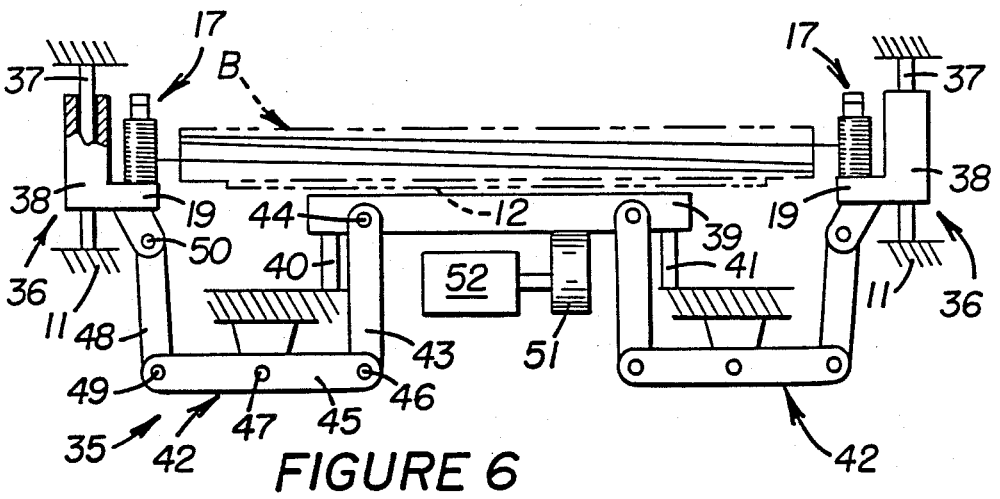
FIGURE 6
FIGURE 5
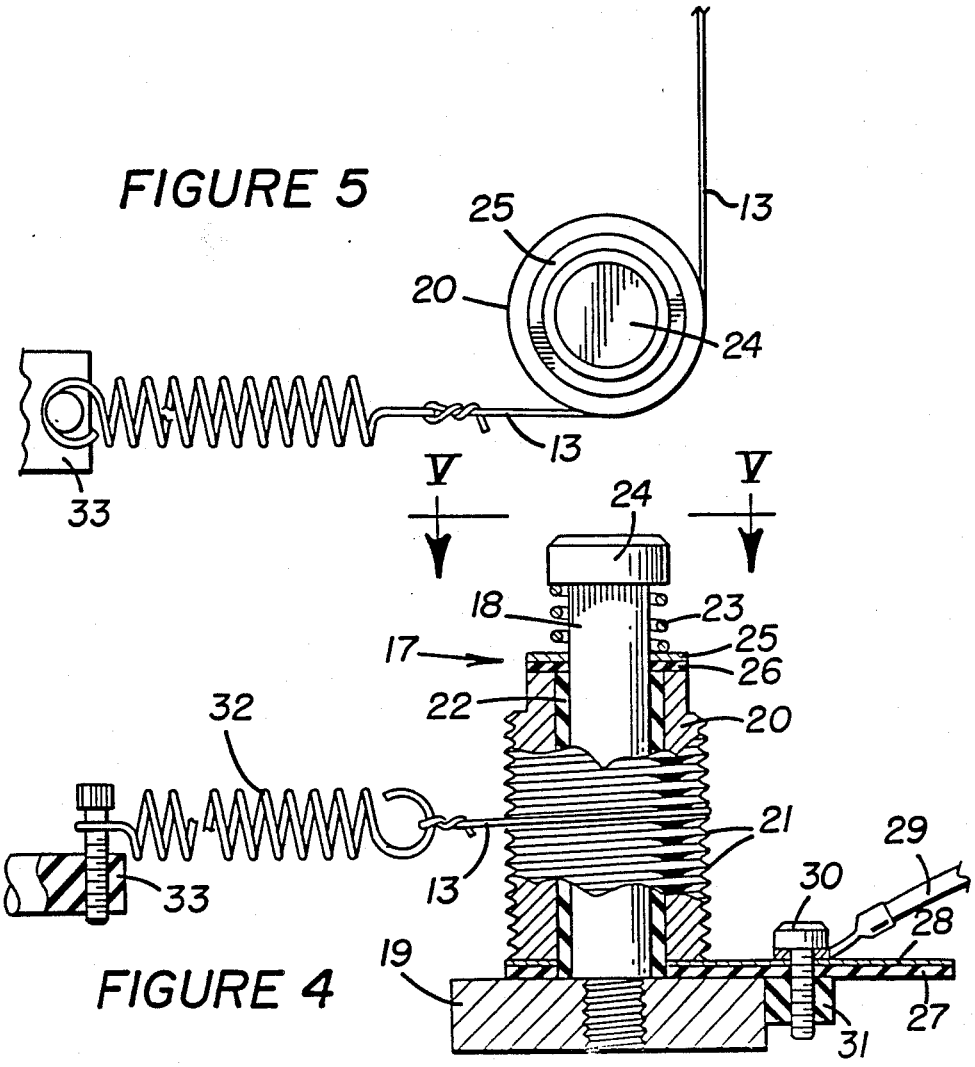
FIGURE 4

APPARATUS FOR MAKING TAPERED PLASTIC SHINGLES

DESCRIPTION

1. TECHNICAL FIELD

This invention relates generally to the making of roofing shingles and more particularly to an apparatus and method for making tapered plastic shingles, preferably with a textured surface.

2. BACKGROUND ART

Various materials are currently used for roofing shingles, such as asphalt, saturated rag felt, cedar shake, ceramic-tile, aluminum and plastic. Plastic shingles have increased in popularity due to their relative low cost, ease of installation, lightness and flame-proof capabilities. Also, the plastic material composing the shingles can be readily colored and textured to exhibit a wide variety of aesthetic appearances.

Although plastic shingles are desirable for many roofing applications, their use has been limited by the need for cost intensive apparatus and methods, required to fabricate the shingles. Although heated wires have been used for cutting materials such as butter, plastic concrete and foam plastic, applicant is unaware of the use of heated wires for the fabrication of roofing shingles in the manner described below. For example, U.S. Pat. No. 4,536,145 teaches the use of heated wires for the purpose of cutting plastic molding forms, used for the casting of concrete.

DISCLOSURE OF INVENTION

This invention provides an economical apparatus and method for making tapered plastic shingles expeditiously.

The apparatus comprises a stationary frame having a conveyor mounted thereon for moving a block of plastic shingle material along a linear path disposed in a horizontal plane. At least one heated wire extends transversely across the path and is disposed at an acute angle relative to the horizontal plane for cutting the block into at least two tapered shingle slabs which are thereafter cut to form shingles of desired widths.

Adjustment means are preferably provided for selectively changing the acute angle defined by the heated wire to thus selectively form the shingles with the desired taper. Control means are also preferably provided for reciprocating the wire vertically to impart a textured surface to the opposed cut surfaces of the shingle slabs when they move through the apparatus.

BRIEF DESCRIPTION OF THE DRAWINGS

Other objects of this invention will become apparent from the following description and accompanying drawings wherein:

FIG. 4 is a sectional and elevational view, generally taken in the direction of arrows IV—IV in FIG. 3, showing attachment of an end of one of the wires to an adjustment mechanism;

FIG. 5 is a top plan view of the adjustment mechanism, taken in the direction of arrows V—V in FIG. 4; and FIG. 6 is a frontal elevational view schematically illustrating a mechanism for reciprocating the wire vertically to impart a textured surface to opposed cut surfaces of the shingle slabs.

BEST MODE OF CARRYING OUT THE INVENTION

Figure 1:
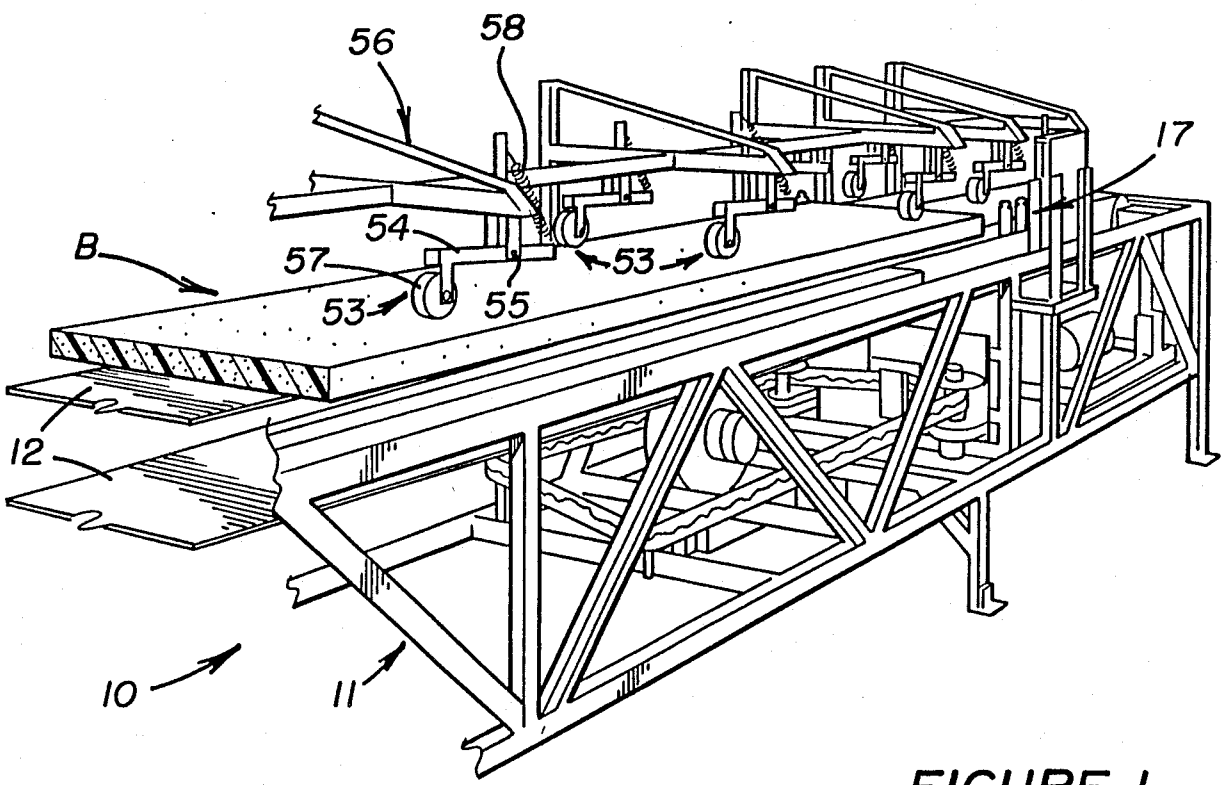
FIG. 1 is a partial perspective view of an apparatus for making tapered plastic shingles.
Figure 3:
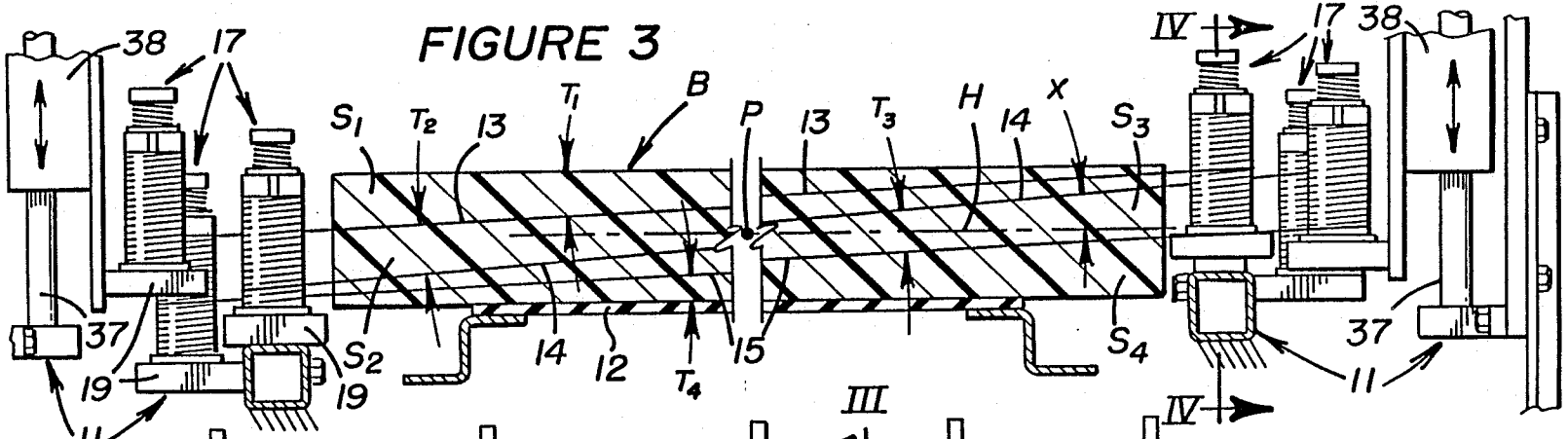
FIG. 3 is a transverse sectional view, generally taken in the direction of arrows III—III in FIG. 2, illustrating principles of operation of the apparatus, including a plurality of heated wires for cutting a block of plastic shingle material into tapered shingle slabs.
Figure 2:
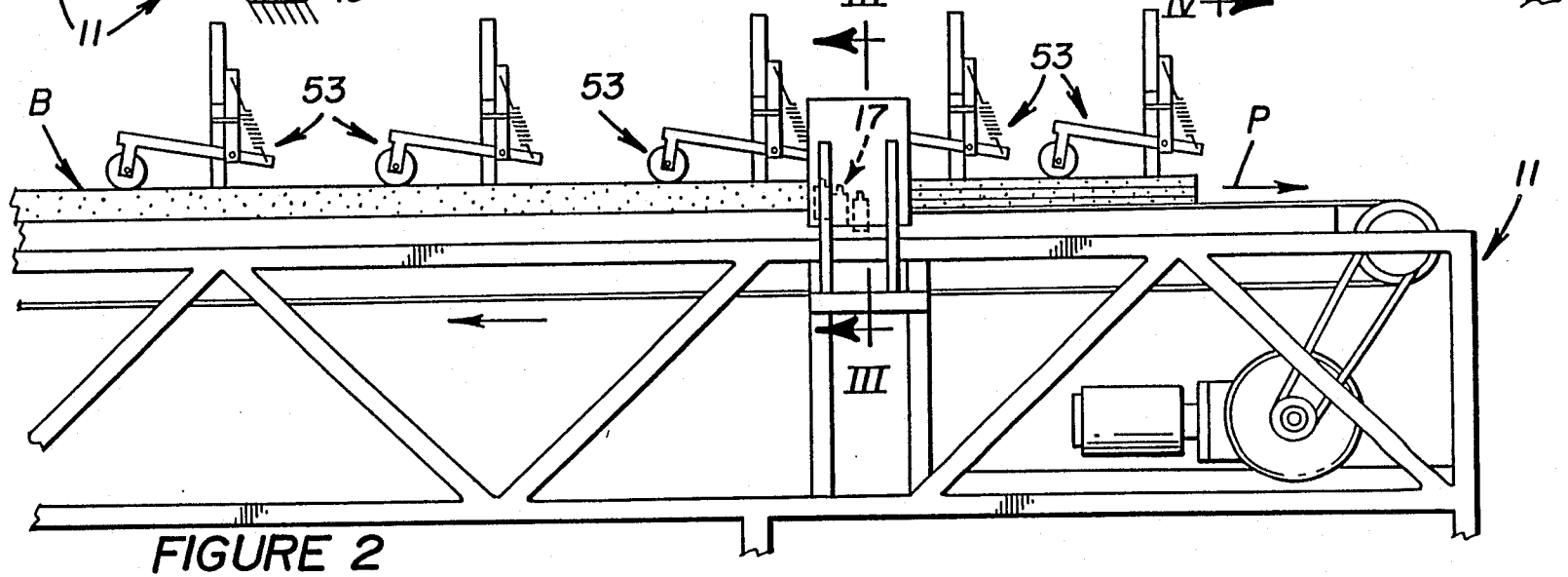
FIG. 2 is a side elevational view of the apparatus.

FIGS. 1 and 2 partially illustrate an apparatus 10 for making tapered plastic shingles from a block of plastic shingle material B. As described more fully hereinafter, a frame 11 of the apparatus has an endless conveyor belt 12 mounted thereon for moving the block along a linear path P, disposed in an imaginary horizontal plane H, as schematically illustrated in FIG. 3. A plurality of heated wires 13–15 extend transversely across path P and are each disposed at an acute angle X relative to plane H for cutting the block to form a plurality of tapered and substantially identical shingle slabs $S_1$–$S_4$.

In the illustrated embodiment, three wires 13, 14 and 15 are utilized to form four separate shingle slabs. It should be understood, however, that a single wire or any other desired number of wires could be utilized for shingle making purposes with the size of block B and the orientation of the wire or wires being predetermined accordingly. While the block is cut longitudinally to define the shingle slabs, the shingle slabs are cut to form shingles of desired width by additional heated wires (not shown) that are moved vertically through the slabs when they are at rest.

As shown in FIGS. 4 and 5, an adjustment means including a holder 17 anchors each end of each wire 13, 14 and 15 to a respective side of conveyor belt 12. Each holder comprises a bolt 18 threadably attached to a support 19 and a brass sleeve 20 having screw threads 21 formed externally thereon. Brass sleeve 20 is slip-fit onto an electrical insulating sleeve 22, mounted on bolt 18. Sleeves 20 and 22 are biased vertically downwardly by a compression coil spring 23, mounted between a head 24 of bolt 18 and a metal washer 25. Washer 25 overlies an electrical insulating washer 26 which, in turn, overlies the upper ends of sleeves 20 and 22.

An electrical insulating fiberglass member 27, having a copper plating 28 formed thereon, is mounted on support 19 and underlies sleeve 20. An electrical lead 29 is attached to member 27 by a machine screw 30, threadably attached to a nut 31 composed of an electrical insulating material. Thus, electrical current from lead 29 will be conducted to heated wire 13, for example, via copper plating 28 and sleeve 20. One end of wire 13 is attached to a first end of a tension coil spring 32, having its opposite second end attached to an electrical insulator 33 mounted on support 19 as described more fully hereinafter.

From the above description it can be seen that holder 17 functions as an adjustment means for selectively moving wire 13 vertically. Thus, the operator is enabled to selectively change acute angle X (FIG. 3) and the tapers $T_1$ and $T_2$ accorded to the formed shingles slabs $S_1$ and $S_2$ respectively. In particular, manual rotation of sleeve 20 will either raise or lower the wire, which engages within threads 21, depending on the direction of rotation of the sleeve. As shown in FIG. 5, wire 13 is partially wrapped (e.g., 90°) over screw threads 21 whereby rotation of sleeve 20 will thus vertically adjust this end of the wire relative to the other end of the wire and horizontal plane H (FIG. 3).

Block B is preferably fabricated to exhibit a rectangular cross-section (FIG. 3). The orientation of first wire 13 will determine included acute angle of taper $T_1$ for slab $S_1$, whereas first and second wires 13 and 14 will determine angle of taper $T_2$ of slab $S_2$. Likewise, second and third wires 14 and 15 determine angles of tapers $T_3$ and $T_4$ for slabs $S_3$ and $S_4$. As schematically illustrated in FIG. 3, the first end of wire 13 and the second end of wire 15 are preferably mounted for reciprocal vertical movements on frame 11 of the apparatus whereas the first ends of wires 14 and 15 and the second ends of wires 13 and 14 are fixedly mounted on the frame.

Apparatus 10 also preferably includes control means 35 (FIG. 6) for reciprocating wires 13 and 15 vertically relative to path P (FIG. 3) to impart a textured surface onto opposed surfaces of the two shingle slabs cut by each of the wires. For example, the first or left end of wire 13 in FIG. 3 is adapted to reciprocate vertically (e.g., 0.25 inch) to cut textured surfaces into the opposed surfaces of shingle slabs $S_1$ and $S_2$ during the cutting of block B by the wire. The second or right end of wire 15 in FIG. 3 is reciprocated in a like manner to cut textured surfaces into the opposed surfaces of shingle slabs $S_3$ and $S_4$. Thus, each of the formed shingles will exhibit an exposed textured surface on its outer side, when installed on a roof.

As schematically illustrated in FIG. 6, control means 35 includes a mounting arrangement 36 attached to support 19, having the first end of wire 13 attached thereto, for permitting the support and wire to reciprocate vertically. The mounting arrangement may include a vertically disposed post 37 fixed to frame 11 and a bearing sleeve 28 secured to support 19 and reciprocally mounted on the post. Thus, vertical reciprocation of the sleeve will, in turn, reciprocate the first end of wire 13 to cut textured surfaces into the opposed surfaces of shingle slabs $S_1$ and $S_2$, cut by the wire.

Control means 35 further includes a second support 39 reciprocally mounted on a pair of vertically disposed and laterally spaced posts 40 and 41 secured to frame 11. A linkage 42 is interconnected between supports 19 and 39 for reciprocating support 19 in response to reciprocation of support 39. The linkage comprises a link 43 havng a first end pivotally connected to support 39 by a pin 44 and its second end pivoted to the first end of a crank 45 by a pin 46. Crank 45 is pivotally mounted by a pin 47 on frame 11 and has its second end pivotally mounted to the first end of a second link 48 by a pin 49. The second end of link 48 is pivotally connected to support 19 by a pin 50 whereby reciprocal motion of support 39 will translate into reciprocal motion of support 19 via linkage 42.

Various state of the art means can be utilized as pattern means for determining the textured surfaces imparted to the opposed cut surfaces of the shingle slabs. FIG. 6 schematically illustrates one possible form of such pattern means as comprising a plate cam 51 having its outer periphery suitably contoured to impart the desired reciprocal motion to support 39 which functions as a cam follower. The cam can be rotated by a conventional motor 52, suitably mounted in the apparatus.

As shown in FIG. 1, a plurality of longitudinally and laterally spaced hold-down means 53 are mounted on frame 11, above conveyor belt 12, for applying pressure vertically downwardly on block B. A support bar 54, pivotally mounted at 55 on an upper portion 56 of frame 11, and a roller 57 rotatably mounted on one end of the support bar. A tension coil spring 58 is interconnected between frame portion 56 and a second end of support bar 54 to bias roller 57 into engagement with block B.

Modifications well-known to those skilled in the arts to which this invention pertains may be made to the apparatus without departing from the spirit and scope of such invention. For example, a more sophisticated control and pattern means could be employed, such as an endless tape having the desired pattern of shingle surface texture imprinted thereon which is arranged to pass adjacent to an electric eye which, in turn, will control the reciprocation of support 39. The electric eye, in turn, could control reciprocation of support 39 via a motor-driven pinion meshed with a rack gear secured to the support.

I claim:

1. Apparatus for making tapered plastic shingles comprising a stationary frame, conveyor means mounted on said frame for moving a block of plastic shingle material along a linear path disposed in a horizontal plane, at least one heated wire means mounted on said stationary frame to extend transversely across said path and disposed at an acute angle relative to said plane for cutting said block to form at least two tapered shingle slabs, and adjustment means mounted on said frame transversely of said path and attached to an end of said wire means for selectively changing said acute angle by vertically raising or lowering and then setting the end of said wire means relative to said plane.

2. The apparatus of claim 1 further comprising means for fixing a first end of said wire means relative to said path and wherein said adjustment means is adapted to selectively move a second end of said wire means vertically relative to the first end of said wire means and said plane.

3. The apparatus of claim 1 further comprising hold-down means for applying pressure vertically downwardly onto said block and towards said conveyor means.

4. The apparatus of claim 3 wherein said conveyor means comprises an endless belt and said hold-down means comprising a plurality of rollers mounted vertically above said belt.

5. The apparatus of claim 4 wherein said hold-down means further comprises biasing means for biasing each of said rollers vertically downwardly into engagement with said block.

6. The apparatus of claim 1 wherein said adjustment means comprises a support and a vertically disposed member having screw threads formed externally thereon and rotatably mounted on said support, the second end of said wire means partially wrapped over said screw threads whereby rotation of said member will vertically adjust the second end of said wire means relative to the first end of said wire means and said plane.

7. The apparatus of claim 6 wherein said member comprises a metallic sleeve and said adjustment means further comprises a bolt attached to said support and having said sleeve mounted thereon, means for electrically insulating said sleeve from said bolt and said support and means for conducting electrical current to said sleeve to heat said wire means.

8. The apparatus of claim 6 wherein said second means further comprises tensioned spring means for attaching the second end of said wire means to said support.

9. The apparatus of claim 1 further comprising pattern forming means connected to said adjustment means for vertically reciprocating said adjustment means and said wire means to form patterned surface textures on opposed surfaces of two of said shingle slabs cut by said wire means.

10. The apparatus of claim 9 wherein said pattern forming means comprises a first support having said adjustment means mounted thereon, mounting means mounting said first support for vertical movements on said frame and linkage means for selectively moving said first support vertically on said mounting means.

11. The apparatus of claim 10 wherein said pattern forming means further comprises a second support, second mounting means mounting said second support for vertical movements on said frame, said linkage means interconnected between said first and second supports, pattern means for determining said patterned surface textures, and means for reciprocating said first support vertically via said linkage means in response to variations in said pattern means whereby the first end of said wire means will reciprocate vertically to impart said pattern surface texture to the opposed surfaces of said two shingle slabs during the cutting of said block by said wire means.

12. The apparatus of claim 1 wherein said wire means comprises a first wire having first and second opposite ends thereof attached to a pair of said adjustment means mounted on opposite sides of said conveyor means.

13. The apparatus of claim 12 wherein said wire means further comprises a second wire having first and second opposite ends thereof attached to a pair of said adjustment means mounted on opposite sides of said conveyor means, said first and second wires positioned to form an acute angle therebetween defining an included acute angle of taper on one of said shingle slabs.

14. The apparatus of claim 13 wherein said wire means further comprises a third wire having first and second opposite ends thereof attached to a pair of said adjustment means mounted on opposite sides of said conveyor means, said second and third wires positioned to form an acute angle therebetween defining an included angle of taper on another one of said shingle slabs, the first and second ends of said first, second and third wires being positioned on opposite first and second sides of said conveyor means.

15. The apparatus of claim 14 wherein the adjustment means attached to the second end of said first wire, the first and second ends of said second wire, and the first end of said third wire are fixedly mounted on said frame.

16. The apparatus of claim 15 further comprising means for reciprocating the first end of said first wire and the second end of said third wire vertically to impart a textured surface onto opposed surfaces of said shingle slabs during cutting of said block by said first, second and third wires.

17. In an apparatus for making tapered plastic shingles, means for imparting a textured surface to said shingles comprising a stationary frame, conveyor means mounted on said frame for moving a block of plastic shingle material along a linear path disposed in a horizontal plane, at least one heated wire means extending transversely across said path at an acute angle relative to said plane for cutting said block to form at least two shingle slabs, adjustment means attached to said wire means for selectively changing said acute angle, pattern means for determining a non-uniform or uniform textured surfaces to be imparted to opposed cut surfaces of said shingle slabs, and control means for reciprocating said wire means vertically relative to said path to impart said textured surface onto the opposed surfaces of said shingle slabs in response to said pattern means during the cutting of said block by said wire means.

18. The apparatus of claim 17 wherein said control means comprises a first support attached to said wire means and having mounting means for mounting said first support for vertical movements on said apparatus and linkage means for reciprocating said first support vertically on said mounting means.

19. The apparatus of claim 18 wherein said control means further comprises a second support, second mounting means mounting said second support for vertical movements on said apparatus, said linkage means interconnected between said first and second supports, and drive means for reciprocating said first support vertically via said linkage means in response to variations of said pattern means whereby said wire means will reciprocate vertically to impart said textured surface to opposed surfaces of said shingle slabs during the cutting of said block by said wire means.

20. The apparatus of claim 17 wherein said wire means comprises a first wire having first and second opposite ends thereof mounted on opposite sides of said conveyor means.

21. The apparatus of claim 20 wherein said wire means further comprises a second wire having first and second opposite ends thereof mounted on opposite sides of said conveyor means, said first and second wires positioned to form an acute angle therebetween defining an included acute angle of taper on one of said shingle slabs.

22. The apparatus of claim 21 wherein said wire means further comprises a third wire having first and second opposite ends thereof mounted on opposite sides of said conveyor means, said second and third wires positioned to form an acute angle therebetween defining an included angle of taper on another one of said shingle slabs, the first and second ends of said first, second and third wires being positioned on opposite first and second sides of said conveyor means.

23. The apparatus of claim 22 wherein the second end of said first wire, the first and second ends of said second wire, and the first end of said third wire are fixedly mounted on said frame.

24. The apparatus of claim 21 wherein said control means reciprocates the first end of said first wire and the second end of said third wire vertically to impart said textured surface onto the opposed surfaces of said shingle slabs during cutting of said block by said first, second and third wires.

* * * * *